US007682166B2

(12) United States Patent
Chang

(10) Patent No.: US 7,682,166 B2
(45) Date of Patent: Mar. 23, 2010

(54) ELECTRONIC DEVICE WITH GROUNDING MECHANISM

(75) Inventor: Cheng-Lung Chang, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 55 days.

(21) Appl. No.: 11/959,258

(22) Filed: Dec. 18, 2007

(65) Prior Publication Data

US 2009/0061663 A1 Mar. 5, 2009

(30) Foreign Application Priority Data

Aug. 28, 2007 (CN) ..... 2007 1 0201482

(51) Int. Cl.
*H01R 4/66* (2006.01)

(52) U.S. Cl. ..... 439/92; 439/66; 439/74; 439/862

(58) Field of Classification Search ..... 439/92, 439/862, 66, 74, 75
See application file for complete search history.

(56) References Cited

U.S. PATENT DOCUMENTS

| | | | | |
|---|---|---|---|---|
| 6,077,130 | A * | 6/2000 | Hughes et al. | 439/862 |
| 6,398,559 | B2 * | 6/2002 | Tanaka | 439/66 |
| 6,409,529 | B1 * | 6/2002 | Liu et al. | 439/188 |
| 2003/0031004 | A1 * | 2/2003 | Hooper | 361/801 |

* cited by examiner

*Primary Examiner*—Tho D Ta
*Assistant Examiner*—Travis Chambers
(74) *Attorney, Agent, or Firm*—Steven M. Reiss

(57) ABSTRACT

A grounding mechanism (20) is electronically connected to a main circuit board (52), a subsidiary circuit board (53) and a key conductive member (55). The grounding mechanism includes an elastic member (30). The elastic member includes a mounting portion (31), a conductive portion (32) and a resisting portion (35). The mounting portion is electronically fixed to the main circuit board. The conductive portion extends from one side of the mounting portion for electronically connecting to the key conductive member. The resisting portion extends from another side of the mounting portion for resisting the subsidiary circuit board.

15 Claims, 9 Drawing Sheets

ELECTRONIC DEVICE WITH GROUNDING MECHANISM

BACKGROUND OF THE INVENTION

1. Field of the Invention

The present invention relates to electronic device and, particularly, to an electronic device with a grounding mechanism that may be relatively easy to install.

2. Discussion of the Related Art

With the development of wireless communication and information processing technologies, electronic devices such as mobile phones and personal digital assistants (PDAs) are now in widespread use, and consumers may now enjoy the full convenience of high technology products anytime and anywhere. Such electronic devices usually include a plurality of electrical components provided therein so as to realize different functions. In order to prevent electrostatic charges from damaging the electrical components, a grounding mechanism is usually disposed for removal of electromagnetic interference and electrostatic charges thereon.

A conventional electronic device includes a main circuit board, an antenna circuit board and a conductive element. The antenna circuit board is disposed at one side of the main circuit board. The conductive element is disposed over the main circuit board. A height of the above three components is different from each other owing to the assembly requirement. When the electronic device is in use, the electrical components generate electromagnetic interference and electrostatic charges. Therefore, a grounding mechanism is required for fast removal of electromagnetic interference and electrostatic charges of the electrical components.

However, a conventional grounding structure of the electronic device is that the main circuit board, the antenna circuit board and the conductive element are respectively connected to a different grounding structure thus, it make the assembly process time consuming. In addition, additional grounding structures also increase the volume of the electronic device, which does not satisfy the miniature requirement for the electronic device.

Therefore, a grounding mechanism is desired in order to overcome the above-described shortcoming.

SUMMARY OF THE INVENTION

One embodiment of the present grounding mechanism is electronically connected to a main circuit board, a subsidiary circuit board and a key conductive member. The grounding mechanism includes an elastic member. The elastic member includes a mounting portion, a conductive portion and a resisting portion. The mounting portion is electronically fixed to the main circuit board. The conductive portion extends from one side of the mounting portion for electronically connecting to the key conductive member. The resisting portion extends from another side of the mounting portion for resisting the subsidiary circuit board.

Other advantages and novel features of the present grounding mechanism will become more apparent from the following detailed description thereof when taken in conjunction with the accompanying drawings.

BRIEF DESCRIPTION OF THE DRAWINGS

Many aspects of the grounding mechanism can be better understood with reference to the following drawings. The components in the drawings are not necessarily drawn to scale, the emphasis instead being placed upon clearly illustrating the principles of the present grounding mechanism. Moreover, in the drawings, like reference numerals designate corresponding parts throughout the several views, in which.

DETAILED DESCRIPTION OF THE INVENTION

The present grounding mechanism 20 may be applied in many different electronic devices such as mobile phone, games player, PDA (personal digital assistant) and so on. In one illustrated embodiment, the grounding mechanism 20 is used in a mobile phone.

Figure 1:
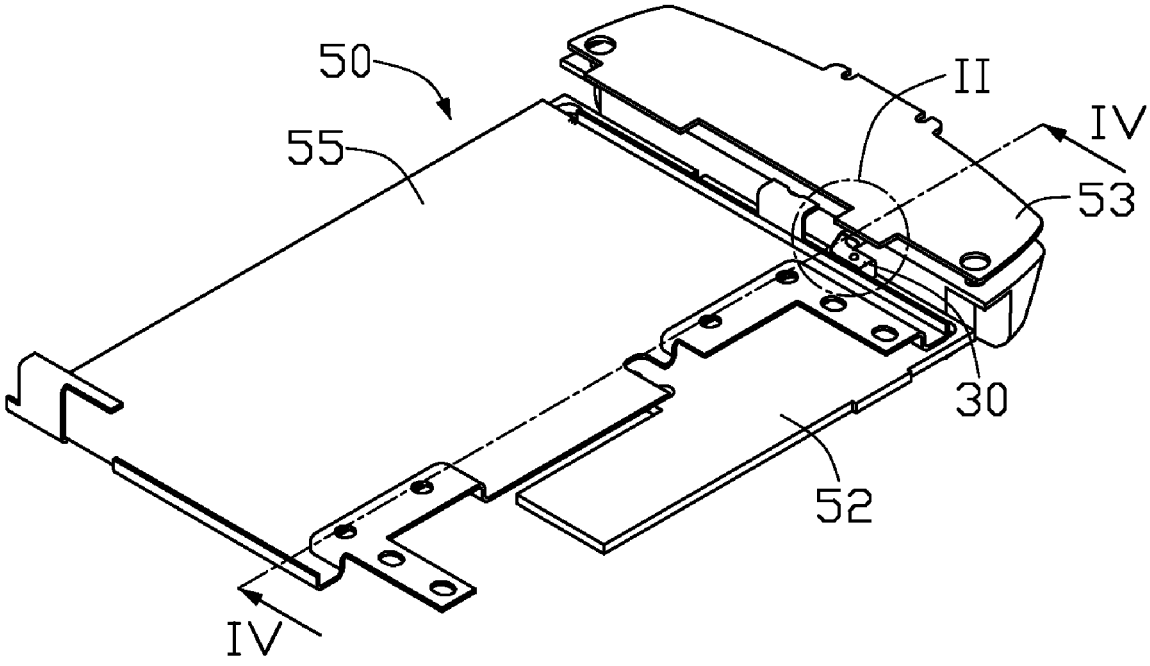
FIG. 1 is an assembled, schematic view of an electronic device showing a main circuit board, a subsidiary circuit board and a key conductive element in accordance with the present embodiment.

Referring to FIG. 1, the mobile phone includes a circuit board combination 50 and a grounding mechanism 20. The grounding mechanism 20 is electronically connected to the circuit board combination 50.

Figure 2:
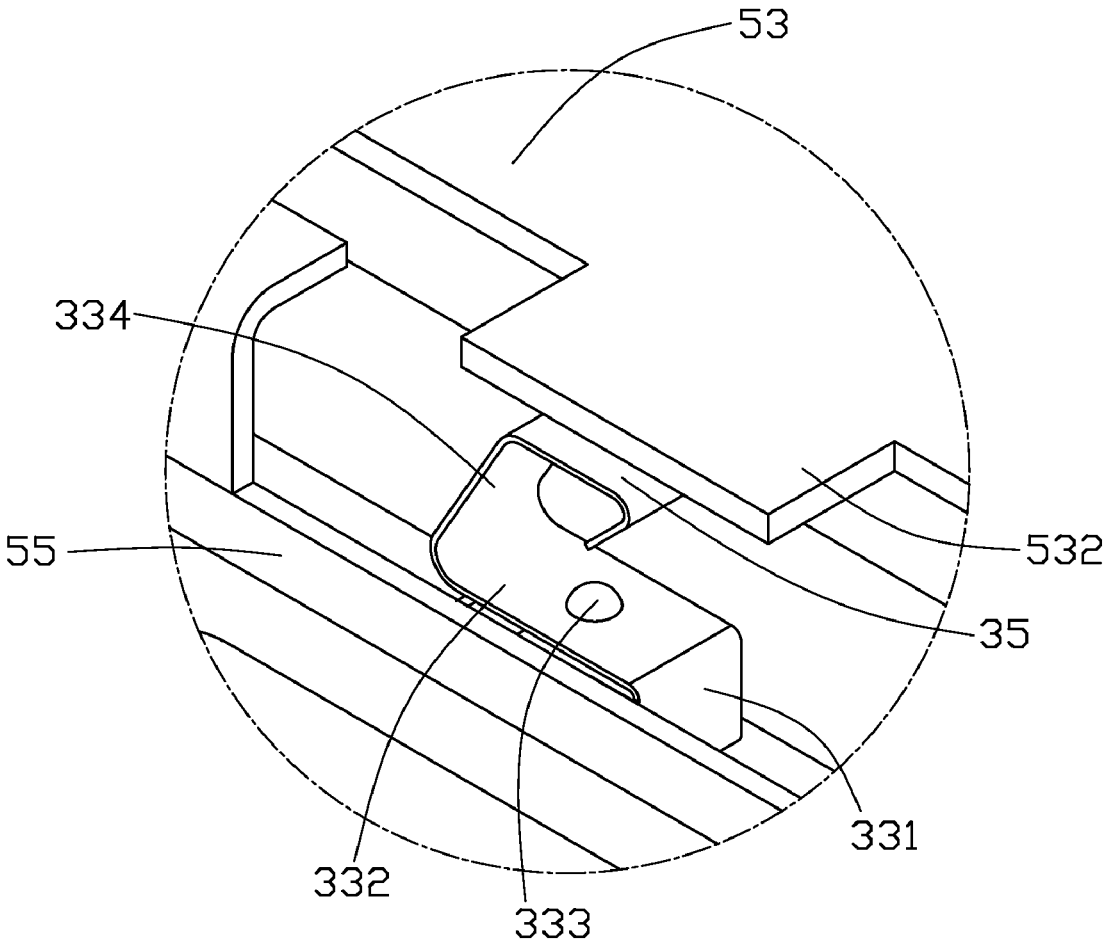
FIG. 2 is a partially, enlarged view along 11 area of FIG. 1.
Figure 3:
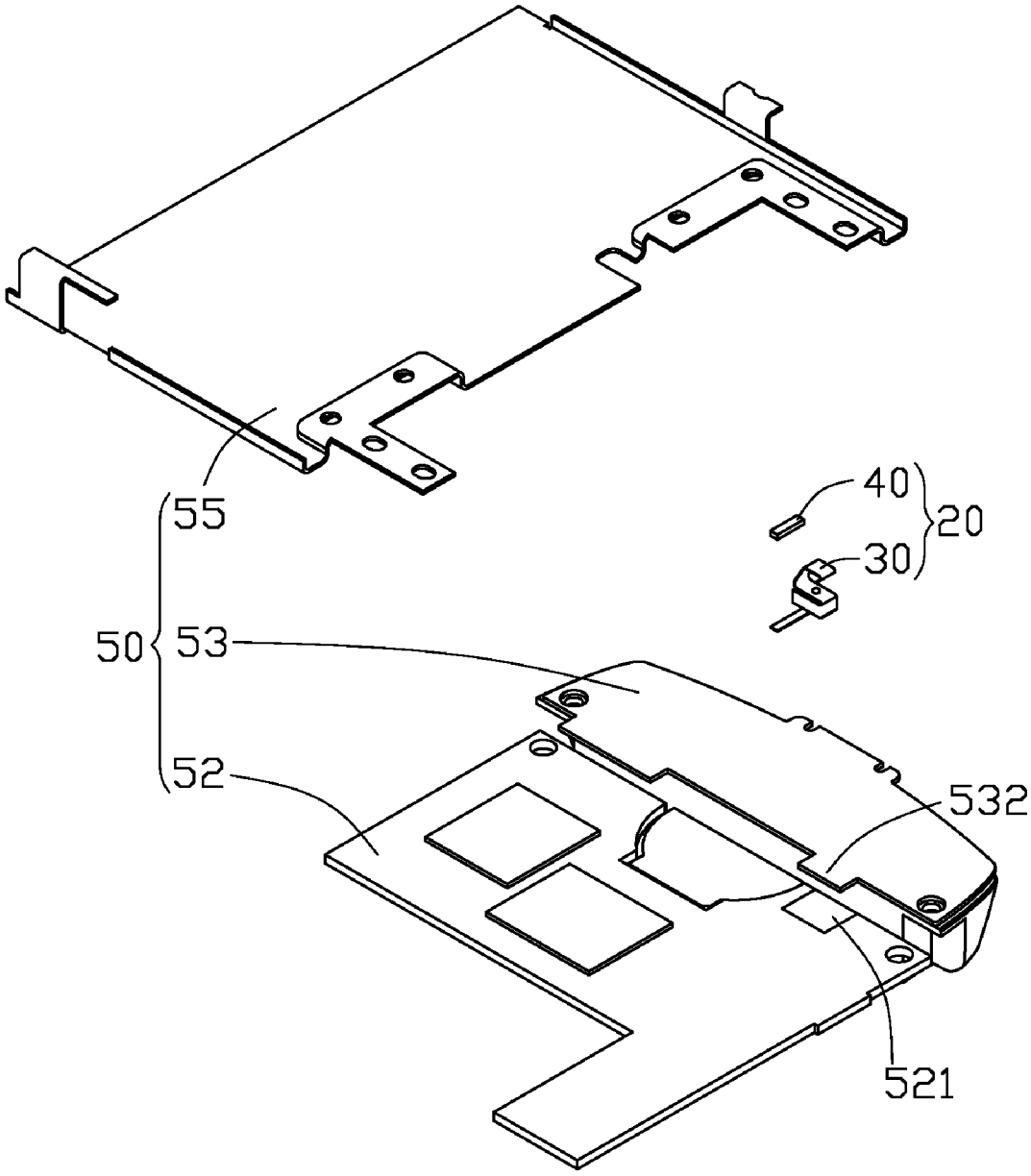
FIG. 3 is an exploded, isometric view of FIG. 1.

Referring to FIGS. 2 to 3, the circuit board combination 50 includes a main circuit board 52, a subsidiary circuit board 53 and a key conductive element 55. A grounding pin 521 is formed at an edge of the main circuit board 52 thereof. The subsidiary circuit board 53 is disposed adjacent to one end of the main circuit board 52. The subsidiary circuit board 53 has an extending portion 532 extended from one side thereof. The extending portion 532 is generally rectangular, and is above the grounding pin 521. The extending portion 532 has a contact portion (not shown) thereon facing the grounding pin 521. The height of the subsidiary circuit board 52 is different from that of the height of the main circuit board 52. The key conductive element 55 is substantially board-like, and is made of metal. The key conductive element 55 is disposed above the main circuit board 52, and is spaced therefrom. The subsidiary circuit board 53 is disposed at one end of the main circuit board 52 and the key conductive element 55.

Figure 4:
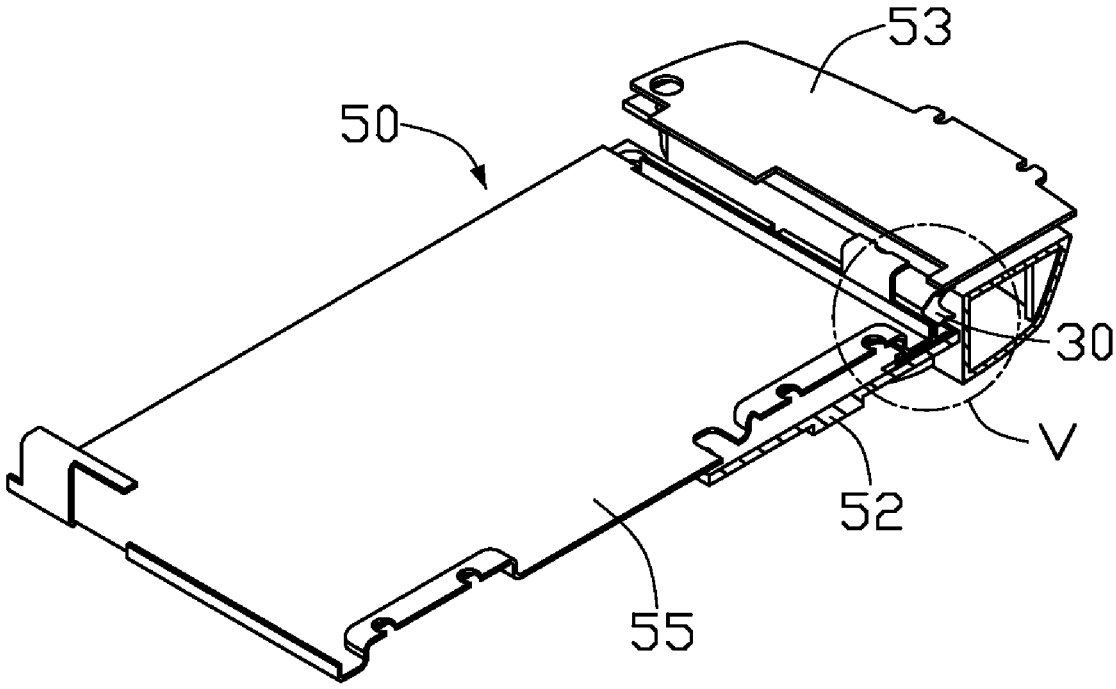
FIG. 4 is a cross-section view of FIG. 1 along IV-IV line thereof.
Figure 5:
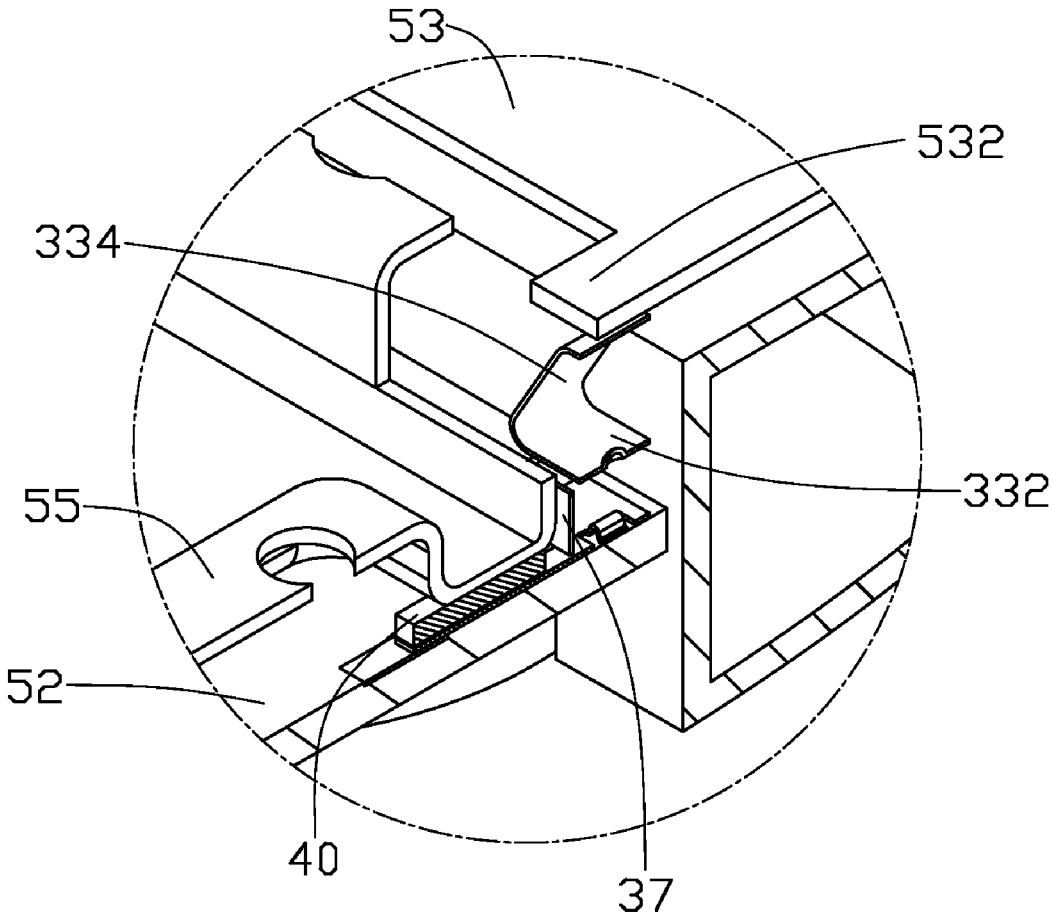
FIG. 5 is a partially enlarged view along V area of FIG. 4.

Referring to FIGS. 4 to 5, the grounding mechanism 20 includes an elastic member 30 and a fixing member 40. The fixing member 40 may be fixed to the elastic member 30 by means of conductive glue or other ways.

Figure 6:
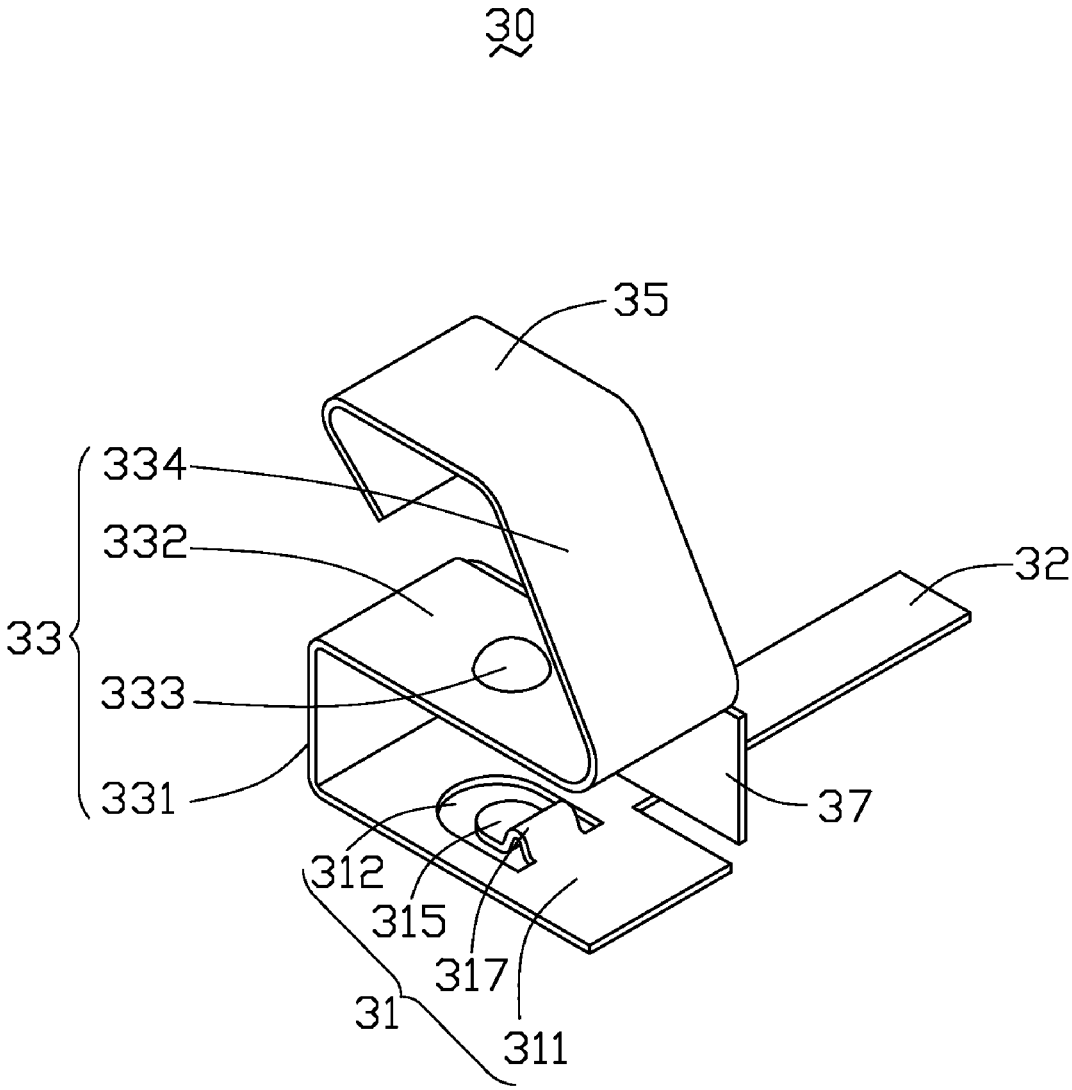
FIG. 6 is a schematic view of an elastic member of a first embodiment thereof.
Figure 7:
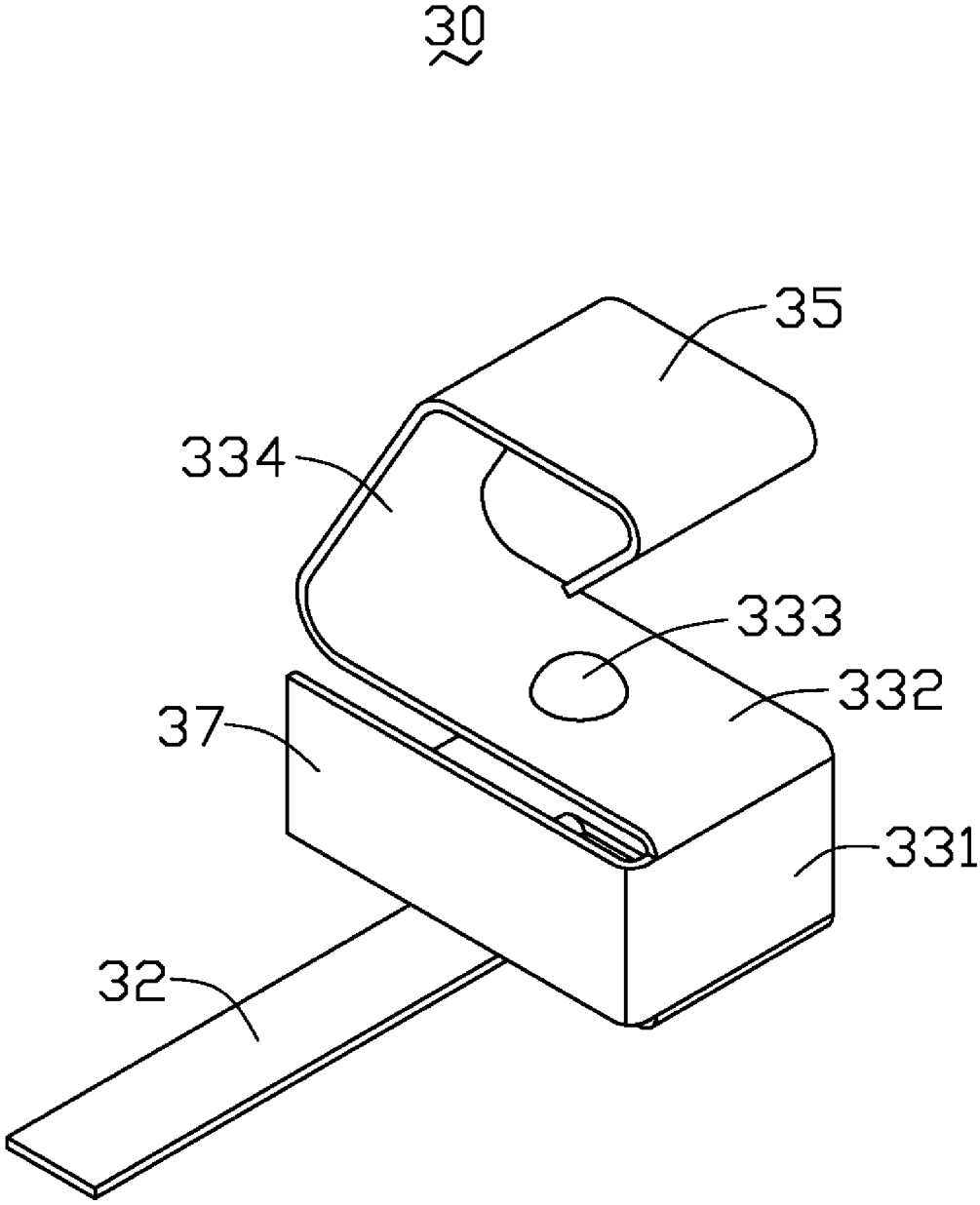
FIG. 7 is similar to FIG. 6, but viewed from another aspect thereof.

The elastic member 30 is made of metal, and is preferably stamped or punched from a sheet material. The elastic member 30 may be attached to the grounding pin 521 of the main circuit board 52 by means of surface mount technology (SMT). Referring to FIGS. 6 and 7, the elastic member 30 includes a mounting portion 31, a conductive portion 32, an elastic portion 33, a resisting portion 35 and a separate plate 37.

The mounting portion 31 is substantially rectangular board-like, and includes a first surface 311. The mounting portion 31 defines a U-shaped through hole 312 at a middle area thereof, and forms a tab 315 therein. The tab 315 protrudes upwardly towards the first surface 311 to form an arcuate projection 317, and forms a recess (not shown) at a corresponding reverse position thereof. When the mounting portion 31 is mounted on the main circuit board 52, the recess of the tab 315 may be filled with solder or glue material so that the mounting portion 51 may be securely attached to the main circuit board 52.

The conductive portion 32 is substantially strip, and perpendicularly extends from a middle position of one side of the mounting portion 31. The conductive portion 32 is coplanar with the mounting portion 51.

The elastic portion 33 extends from another side of the mounting portion 31 adjacent to the conductive portion 32. The elastic portion 33 includes a connecting wall 331 connecting the elastic portion 33 with the mounting portion 31, a bridging wall 332 disposed opposite to the first surface 311 of the mounting portion 31 and an incline wall 334. The above walls are made of a sheet metal to be bent so as to form an irregular shape. The connecting wall 331 perpendicularly extends from the mounting portion 31. The bridging wall 332 is perpendicularly extending from one side of the connecting wall 331, and is parallel with the mounting portion 31. The bridging wall 332 has a semi-circular protrusion 333 formed at a central area thereof. The incline wall 334 extends from the bridging wall 332 toward the connecting wall 331 and is formed with the bridging wall 332 in an approximately acute angle.

The resisting portion 35 is substantially board-like, and extends from one side of the incline wall 334. The resisting portion 35 is in parallel disposed above the bridging portion 332. A distal end of the resisting portion 35 is bent to form a clasp.

The separate plate 37 is substantially board-like, and perpendicularly extends from the connecting wall 331. The separate plate 37 is positioned above the conductive portion 32 in between the conductive portion 32 and the mounting portion 31.

Referring to FIGS. 3 and 5, the fixing member 40 is substantially rectangular, and is made of conductive material. The fixing member 40 may be fixed to the conductive portion 32 of the elastic member 30 by means of conductive glue, thereby electronically connected to the key conductive element 55.

In assembly, referring to FIGS. 2 and 4, when the grounding mechanism 20 is assembled with the electronic device, the mounting portion 31 and the conductive portion 32 of the elastic member 30 are fixed to the grounding pin 521 of the main circuit board 52 by means of SMT technology. The resisting portion 35 resists the extending portion 532 of the subsidiary circuit board. Then, the key conductive member 55 is disposed between the main circuit board 52 and the subsidiary circuit board 53. At the same time, the separate plate 37 resists the key conductive element 55. After that, the fixing member 40 is inserted between the key conductive element 55 and the conductive portion 332. Therefore, the elastic member 30 is electronically connected to the main circuit board 52, the subsidiary circuit board 53 and the key conductive element 55.

A main advantage of the grounding mechanism is that the elastic member 30 is integrally formed together so that the elastic member 30 may integrate several grounding apparatus to a whole. This will greatly reduce the number of the grounding apparatus, and also decrease the assemble process of the electronic device so that the costs are greatly reduced. In addition, this will reduce a space occupied inside of the electronic device.

Figure 8:
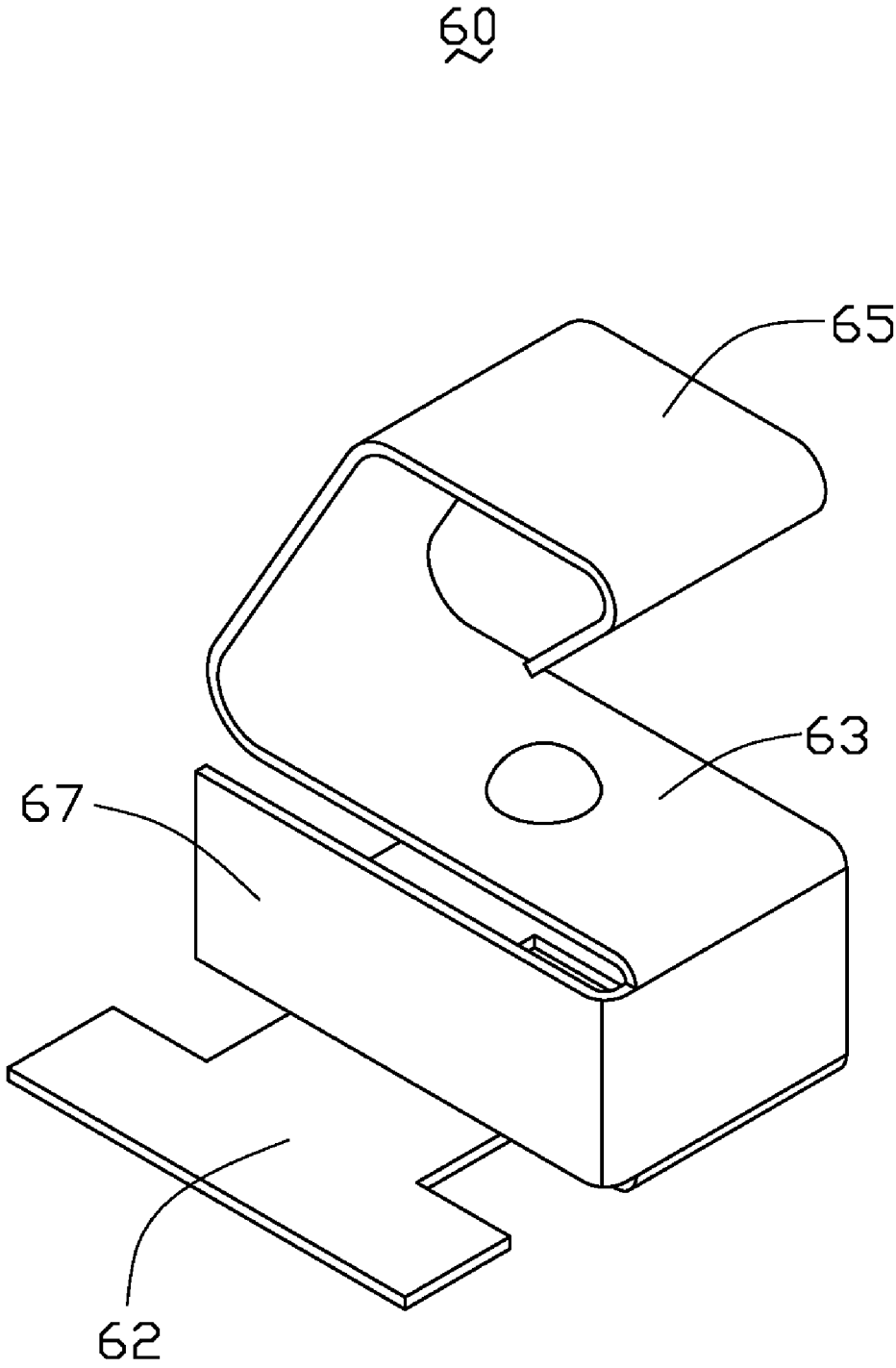
FIG. 8 is a schematic view of an elastic member of a second embodiment thereof.
Figure 9:
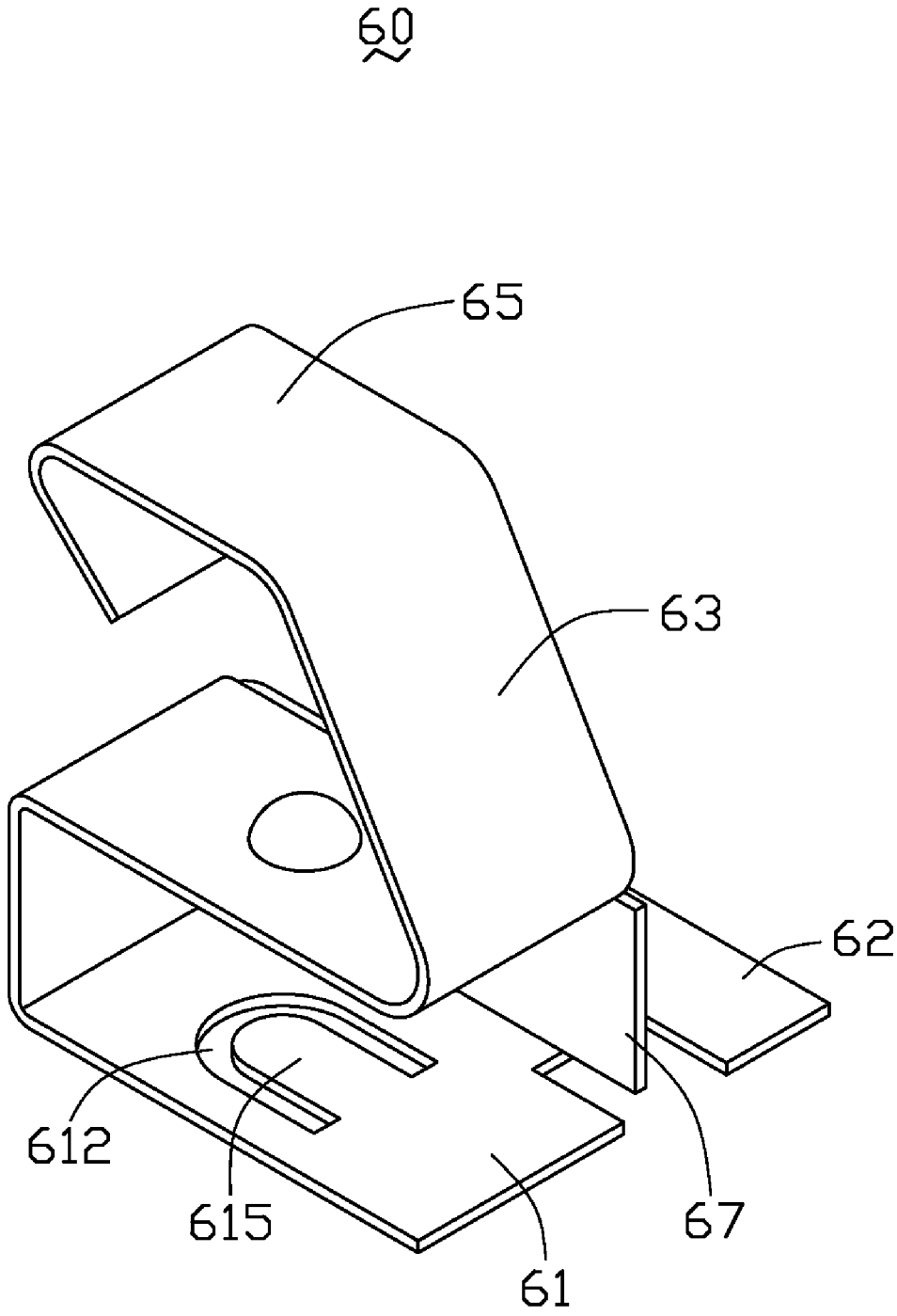
FIG. 9 is similar to FIG. 8, but viewed from another aspect thereof.

In a second embodiment, referring to FIGS. 8 and 9, the elastic member 60 includes a mounting portion 61, a conductive portion 62, an elastic portion 63, a resisting portion 65 and a separate plate 67. The mounting portion 61 defines a U-shaped through hole 612 and a tab 615 formed therein. The elastic member 60 is mainly similar to that of the first embodiment. The difference is that the tab 615 is flat. The conductive portion 62 extends from the mounting portion 61 to form T-shaped. The assembled process of the second embodiment is similar to the first embodiment.

Alternatively, the fixing member 40 may be replace with a raised portion integrately formed on the conductive portion. It is to be understood that the through hole of the mounting portion 312 may have shapes other than shown above such as rectangular, polygon or un-regular shape. It is also to be understood that the conductive portion 32 may be replaced with a fan shape or an irregular shape and so on.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A grounding mechanism electronically connected to a main circuit board, a subsidiary circuit board and a key conductive member, the key conductive member being disposed above and spaced from the main circuit board, the main circuit board having a grounding pin, the grounding mechanism comprising an elastic member, the elastic member comprising:

a mounting portion electronically fixed to the grounding pin of the main circuit board, the mounting portion having a through hole defined therein and a tab formed at a middle area thereof, the tab extending into the through hole, and the tab forming a projection;

a conductive portion extending from one side of the mounting portion for electronically connecting to the key conductive member; and a resisting portion extending from another side of the mounting portion for resisting the subsidiary circuit board.

2. The grounding mechanism as claimed in claim 1, wherein the through hole is U-shaped.

3. The grounding mechanism as claimed in claim 1, wherein the tab defines a recess corresponding to the projection at a reverse position thereof configured for filling with connecting material.

4. The grounding mechanism as claimed in claim 1, wherein the resisting portion has a clasp at one end thereof.

5. The grounding mechanism as claimed in claim 1, further comprising a fixing member, and the fixing member is disposed on the conductive portion of the elastic member.

6. The grounding mechanism as claimed in claim 1, wherein the elastic member further comprises an elastic portion, and the elastic portion is connected to the mounting portion and the resisting portion.

7. The grounding mechanism as claimed in claim 6, wherein the elastic portion includes a connecting wall, a bridging wall and an incline wall, the connecting wall perpendicularly extends from the mounting portion, the bridging wall is parallel with the mounting portion, and the incline wall is angled with the bridging wall.

8. The grounding mechanism as claimed in claim 7, wherein the elastic member further comprises a separate plate, the separate plate extends from the connecting wall, and is disposed over the conductive portion.

9. An electronic device comprising:

a main circuit board having a grounding pin;

a subsidiary circuit board disposed at one side of the main circuit board;

a key conductive member disposed between the main circuit board and the subsidiary circuit board, the key conductive member being spaced from the main circuit board;

a grounding mechanism being electronically connected the subsidiary circuit board and the key conductive member to the grounding pin of the main circuit board; wherein the grounding mechanism includes an elastic member and a fixing member, the elastic member is disposed on the main circuit board, and the fixing member is disposed on the elastic member; wherein the elastic member includes a mounting portion, a conductive portion and a resisting portion, the mounting portion is electronically fixed to the grounding pin of the main circuit board, the conductive portion extends from one side of the mounting portion for electronically connecting to the key conductive member, and the resisting portion extends from another side of the mounting portion for resisting the subsidiary circuit board; and wherein the mounting portion has a through hole defined therein and a tab formed at a middle area thereof, the tab extends into the through hole, and the tab forms a projection.

10. The electronic device as claimed in claim 9, wherein the through hole is U-shaped.

11. The electronic device as claimed in claim 9, wherein the tab defines a recess corresponding to the projection at a reverse position thereof configured for filling with connecting material.

12. The electronic device as claimed in claim 9, wherein the elastic member further comprises an elastic portion, and the elastic portion is connected to the mounting portion and the resisting portion.

13. The electronic device as claimed in claim 12, wherein the elastic portion includes a connecting wall, a bridging wall and an incline wall, the connecting wall perpendicularly extends from the mounting portion, and the bridging wall is parallel with the mounting portion and the incline wall is angled with the bridging wall.

14. The electronic device as claimed in claim 13, wherein the elastic member further comprises a separate plate, the separate plate extends from the connecting wall, and is disposed over the conductive portion.

15. A grounding mechanism electronically connected to a main circuit board, a subsidiary circuit board and a key conductive member, the grounding mechanism comprising an elastic member, the elastic member comprising:

a mounting portion electronically connected to the main circuit board;

a conductive portion extending from one side of the mounting portion for electronically connecting to the key conductive member;

a connecting wall perpendicularly extending from the mounting portion;

a resisting portion extending from the connecting wall for resisting the subsidiary circuit board; and a separate plate perpendicularly extending from the connecting wall, the separate plate being positioned above the conductive portion between the conductive portion and the mounting portion.

* * * * *